US008857169B2

(12) United States Patent
Takahashi et al.

(10) Patent No.: US 8,857,169 B2
(45) Date of Patent: Oct. 14, 2014

(54) HYDRAULIC DRIVE SYSTEM FOR CONSTRUCTION MACHINE

(75) Inventors: Kiwamu Takahashi, Koka (JP); Yasutaka Tsuruga, Moriyama (JP); Yoshifumi Takebayashi, Koka (JP); Kazushige Mori, Koka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 843 days.

(21) Appl. No.: 13/121,040

(22) PCT Filed: Sep. 9, 2009

(86) PCT No.: PCT/JP2009/065754

§ 371 (c)(1),
(2), (4) Date: Mar. 25, 2011

(87) PCT Pub. No.: WO2010/050305

PCT Pub. Date: May 6, 2010

(65) Prior Publication Data

US 2011/0173964 A1 Jul. 21, 2011

(30) Foreign Application Priority Data

Oct. 31, 2008 (JP) ..... 2008-282031

(51) Int. Cl.
*F15B 11/16* (2006.01)
*E02F 9/22* (2006.01)

(52) U.S. Cl.
CPC ..... *E02F 9/2232* (2013.01); *F15B 2211/253* (2013.01); *E02F 9/2285* (2013.01); *F15B 2211/30535* (2013.01); *F15B 2211/50536* (2013.01); *F15B 2211/50518* (2013.01); *F15B 2211/20546* (2013.01); *F15B 11/163* (2013.01); *E02F 9/2296* (2013.01); *F15B 11/165* (2013.01); *E02F 9/2225* (2013.01)
USPC ..... 60/422; 60/452

(58) Field of Classification Search
CPC ..... E02F 9/22; F15B 11/163; F15B 11/165; F15B 2211/20523; F15B 2211/253; F15B 2211/50518; F15B 2211/55
USPC ..... 60/329, 422, 429, 452, 468
See application file for complete search history.

(56) References Cited

U.S. PATENT DOCUMENTS 5,537,819 A * 7/1996 Kobayashi ..... 60/459
5,848,531 A * 12/1998 Nakamura et al. ..... 60/426

(Continued)

FOREIGN PATENT DOCUMENTS

JP 63-101504 5/1988
JP 63-138026 6/1988

(Continued)

*Primary Examiner* — Thomas E Lazo
(74) *Attorney, Agent, or Firm* — Mattingly & Malur, PC

(57) ABSTRACT

A main relief valve 13 includes a biasing force altering unit 60, which constitutes, in combination with a gate lock valve 23 and a gate lock lever 24, relief pressure altering means for manually switching the relief pressure of the main relief valve 13 between a first pressure (a standard pressure of 25 MPa, for example) and a second lower pressure for engine start-up (e.g., 3.0 MPa). This allows the main relief valve 13 to return the hydraulic fluid discharged from a hydraulic pump 2 to a tank T in conjunction with an unloading valve 9 when multiple actuators 5*a*, 5*b*, . . . are not in operation under the ambient temperature below freezing point. As a result, it is possible to reduce the load on the hydraulic pump during cold engine start-up without compromising the anti-hunting characteristics of the unloading valve, thereby improving the engine start-up performance.

8 Claims, 4 Drawing Sheets

(56) References Cited

U.S. PATENT DOCUMENTS

| | | | | |
|---|---|---|---|---|
| 5,964,090 | A * | 10/1999 | Nam et al. | 60/422 |
| 6,408,676 | B1 * | 6/2002 | Stratton et al. | 73/1.72 |
| 6,584,770 | B2 * | 7/2003 | Tsuruga et al. | 60/452 |
| 6,962,050 | B2 * | 11/2005 | Hiraki et al. | 60/486 |
| 7,810,321 | B2 * | 10/2010 | Yamashita et al. | 60/429 |

FOREIGN PATENT DOCUMENTS

| | | | |
|---|---|---|---|
| JP | 1-119327 | U | 8/1989 |
| JP | 3-55323 | A | 3/1991 |
| JP | 2001-193705 | A | 7/2001 |
| JP | 2004-190749 | | 7/2004 |

* cited by examiner

HYDRAULIC DRIVE SYSTEM FOR CONSTRUCTION MACHINE

TECHNICAL FIELD

The present invention relates to hydraulic drive systems for hydraulic excavators or other construction machines and particularly to a hydraulic drive system for performing load sensing control so that the discharge pressure of a hydraulic pump can exceed the maximum load pressure of multiple actuators by a target differential pressure.

BACKGROUND ART

An example of such a hydraulic drive system is the one disclosed in Patent Document 1. The hydraulic drive system of Patent Document 1 has a main relief valve and unloading valve connected to a hydraulic fluid supply circuit through which pressurized hydraulic fluid flows from a hydraulic pump (i.e., main pump). The main relief valve is a type of safety valve and starts to operate when the loads on actuators are high and the pressure in the hydraulic fluid supply circuit (i.e., the discharge pressure of the hydraulic pump) reaches a relief pressure of, for example, 25 MPa during operation of flow control valves, whereby the circuit pressure can be prevented from exceeding the relief pressure. The unloading valve operates mainly when the flow control valves are not in operation (i.e., placed in neutral position) and control the pressure in the hydraulic fluid supply circuit (i.e., the discharge pressure of the hydraulic pump) such that it becomes higher than a target pressure for load sensing control (e.g., higher than 1.5 MPa) and lower than the relief pressure (e.g., set to 2.0 MPa), thereby reducing energy loss when the flow control valves are in neutral position.

Patent Document 2 also discloses a hydraulic drive system that is capable of switching the relief pressure of a main relief valve between a first value (standard value) and a second value for high-load operation which is greater than the first value.

PRIOR ART REFERENCES

Patent Documents

Patent Document 1: JP-2001-193705-A
Patent Document 2: JP-3-55323-A

SUMMARY OF THE INVENTION

Problems to be Solved by the Invention

The hydraulic drive system of Patent Document 1 that performs load sensing control is configured to return all the hydraulic fluid discharged from the hydraulic pump to a tank via the unloading valve when the flow control valves are in neutral position without control levers being operated. In this state, the discharge amount of the hydraulic pump is controlled to a minimum, but not zero, by load sensing control. The reason for reducing the discharge amount of the hydraulic pump to the minimum, but not to zero, when the control levers are not operated is to increase the initial responsiveness of the actuators when the control levers are operated to move the flow control valves from the neutral position. Even when the control levers are not operated (i.e., the flow control valves are in the neutral position), the hydraulic pump continues to discharge at the minimum flow rate; accordingly, the discharge pressure of the hydraulic pump is influenced by the control characteristics of the unloading valve during that time.

A pump-tilting control mechanism for controlling the tilting amount (i.e., displacement volume) of the hydraulic pump typically includes a torque tilting control unit for reducing the tilting amount of the hydraulic pump when the discharge pressure of the hydraulic pump is high, thereby reducing the discharge amount of the hydraulic pump. While the engine is stopped, the tilting amount of the hydraulic pump is being maximized by a spring included in the torque tilting control unit. Thus, at the time of engine start-up, the tilting of the hydraulic pump is changed from the largest to the smallest by load sensing control.

Hydraulic excavators or other construction machines are used in various environments; they are occasionally used when the ambient temperature is below the freezing point (e.g., as low as −10 degrees Celsius or below). When the engine is started by turning on a keyed starter switch in such a cold environment, the tilting amount of the hydraulic pump is reduced, as stated above, from the largest to the smallest by load sensing control, and the hydraulic pump discharges at the flow rate which corresponds to the tilting angle (displacement volume) of that time. However, under the ambient temperature being low, the hydraulic working fluid is subject to a considerable increase in viscosity, and the unloading valve becomes less responsive. Consequently, it will take more time for the unloading valve to open, causing high pressure to be stuck inside a hydraulic fluid supply line. The viscosity increase of the hydraulic working fluid also affects load sensing control, causing a response lag. During this response lag, the discharge amount of the hydraulic pump becomes excessively high. As a result, the pressure in the hydraulic fluid supply line (the discharge pressure of the hydraulic pump) becomes high and may occasionally reach as high as 10 MPa. Accordingly, the load on the hydraulic pump (hence the load on the engine) also becomes excessively high. This makes it impossible to increase the revolving speed of the engine even by rotating its starter, which degrades the engine start-up performance.

In the hydraulic drive system of Patent Document 2, the relief pressure of the main relief valve is switched, between the first value (standard value) and the second value for high-load operation, which is higher than the first value. Even if such a configuration is applied to a hydraulic drive system that performs load sensing control, high pressure is still present inside its hydraulic fluid supply line during cold engine start-up. Moreover, the load on the hydraulic pump (hence the load on the engine) also becomes excessively high, affecting the engine start-up performance.

A possible method for solving the above problems is to increase the responsiveness of the unloading valve so that it can be more responsive in a cold environment. When the control levers are moved gradually from their neutral position without the control levers being operated, however, the discharge pressure of the hydraulic pump gradually approaches the pressure set for the unloading valve. Thus, increasingly less working fluid returns to the tank via the unloading valve. If the unloading valve is highly responsive at this time, the control of the unloading valve becomes unstable, resulting in oscillation of the valve (i.e., valve hunting).

An object of the present invention is thus to provide a hydraulic drive system for a construction machine that is capable of reducing the load on its hydraulic pump during cold engine start-up without compromising the anti-hunting characteristics of an unloading valve and thereby improving engine start-up performance.

Means for Solving the Problems

To achieve the above object, the invention is 1) a hydraulic drive system comprising: an engine; a variable displacement hydraulic pump driven by the engine; a plurality of actuators driven by pressurized hydraulic fluid discharged from the hydraulic pump; a plurality of flow control valves for controlling the flow rate of the pressurized hydraulic fluid supplied from the hydraulic pump to the actuators; maximum load pressure detecting means for detecting a maximum load pressure from among the load pressures of the actuators when the actuators are in operation and detecting tank pressure when the actuators are not in operation, thereby outputting the detected pressure as a signal pressure; load sensing control means for controlling the displacement volume of the hydraulic pump such that the discharge pressure of the hydraulic pump becomes higher than the signal pressure by a target differential pressure; an unloading valve connected to a hydraulic fluid supply line through which the pressurized hydraulic fluid discharged from the hydraulic pump is supplied to the flow control valves, and operative to open to return the hydraulic fluid discharged from the hydraulic pump to a tank when the discharge pressure of the hydraulic pump is higher than the signal pressure by a pressure set for the unloading valve; a main relief valve connected to the hydraulic fluid supply line and operative to open to return the hydraulic fluid discharged from the hydraulic pump to the tank when the discharge pressure of the hydraulic pump is higher than a first pressure set as relief pressure, thereby limiting the maximum pressure in the hydraulic fluid supply line to the first pressure or below; and relief pressure altering means for manually switching the relief pressure of the main relief valve between the first pressure and a second pressure for engine start-up that is lower than the first pressure and allows the relief valve to return the hydraulic fluid discharged from the hydraulic pump to the tank in conjunction with the unloading valve when the actuators are not in operation.

In the above system 1), the relief pressure altering means is manually operated to switch the relief pressure of the main relief valve from the first pressure (standard pressure) to the second pressure for engine start-up, which is lower than the first pressure. Thus, the main relief valve is allowed to return the hydraulic fluid discharged from the hydraulic pump to the tank in conjunction with the unloading valve when the actuators are not in operation. Consequently, during cold engine start-up, it is possible to prevent a decrease in the responsiveness of the unloading valve and a response lag of load sensing control which are attributable to a viscosity rise in the working fluid and thereby also prevent high pressure from staying inside the hydraulic fluid supply line. It is therefore possible to reduce the load on the hydraulic pump and improve the start-up performance of the engine.

Moreover, since both of the unloading valve and the main relief valve are used to return the hydraulic fluid discharged from the hydraulic pump to the tank, the responsiveness of the unloading valve need not be increased much, whereby the anti-hunting characteristics of the unloading valve are not compromised.

As above, the invention makes it possible to reduce the load on the hydraulic pump during cold engine start-up without compromising the anti-hunting characteristics of the unloading valve, thereby improving the engine start-up performance.

2) In the above hydraulic drive system 1), the main relief valve preferably includes a spring for biasing a valve body of the main relief valve in a valve-closing direction to set the relief pressure of the main relief valve. Further, the relief pressure altering means preferably includes: a biasing force altering unit installed behind the spring of the main relief valve and having a hydraulic fluid chamber for altering the biasing force of the spring by changing the hydraulic pressure in the hydraulic fluid chamber so that the relief pressure of the main relief valve can be switched between the first pressure and the second pressure; valve means for selectively connecting the hydraulic fluid chamber of the biasing force altering unit to a pilot hydraulic fluid source and to the tank; and manual control means for controlling the valve means.

In accordance with the hydraulic drive system 2), the manual control means is operated to control the valve means, thereby selectively connecting the hydraulic fluid chamber of the biasing force altering unit to the pilot hydraulic fluid source and to the tank so that the biasing force of the spring can be changed. Therefore, the relief pressure of the main relief valve can be switched easily and reliably between the first pressure and the second pressure.

3) Preferably, the hydraulic drive system 2) further comprises: a pilot pump; a primary pilot pressure generator connected to a discharge hydraulic line of the pilot pump for generating a primary pilot pressure based on a hydraulic fluid discharged from the pilot pump; a primary pilot pressure hydraulic line into which the primary pilot pressure generated by the primary pilot pressure generator is introduced; a plurality of remote control valves connected to the primary pilot pressure hydraulic line for generating, based on the primary pilot pressure introduced into the primary pilot pressure hydraulic line, control pilot pressures to actuate the respective flow control valves; a gate lock lever installed at the entrance of a cab and operated between lock position and unlock position; and a gate lock valve installed between the primary pilot pressure generator and the primary pilot pressure hydraulic line for disconnecting the primary pilot pressure generator from the primary pilot pressure hydraulic line and connecting the primary pilot pressure hydraulic line to the tank when the gate lock lever is operated in the lock position and for connecting the primary pilot pressure generator to the primary pilot pressure hydraulic line when the gate lock lever is operated in the unlock position, wherein the pilot hydraulic fluid source comprises the pilot pump and the primary pilot pressure generator, the valve means comprises the gate lock valve, and the manual control means comprises the gate lock lever.

In accordance with the hydraulic drive system 3), because the gate lock valve (the valve means) and the gate lock lever (the manual control means) that constitute means for controlling the biasing force altering unit are existing ones, it is possible to achieve a less costly machine configuration with fewer components. In addition, no special control is required to switch the relief pressure of the main relief valve between the first pressure and the second pressure because controlling the gate lock lever to change the state of the gate lock valve changes the state of the biasing force altering unit simultaneously.

4) In any of the above hydraulic drive systems 1) to 3), the second pressure for engine start-up is preferably higher than a pressure equivalent to the target differential pressure for the load sensing control means and smaller than double the pressure set for the unloading valve.

In accordance with the above hydraulic drive system 4), the second pressure for engine start-up is set higher than a pressure equivalent to the target differential pressure for the load sensing control means. Thus, the load sensing control means is prevented from maximizing the displacement volume of the hydraulic pump, which reduces fuel consumption.

Further, the second pressure for engine start-up is set lower than double the pressure set for the unloading valve. Thus, during cold engine start-up, the load on the hydraulic pump can be reduced reliably, thereby improving the engine start-up performance.

5) In any of the above hydraulic drive systems 1) to 3), the second pressure for engine start-up is preferably a pressure that allows the main relief valve to open to return the hydraulic fluid discharged from the hydraulic pump to the tank in conjunction with the unloading valve when the actuators are not in operation under the ambient temperature below freezing point.

In accordance with the hydraulic drive system 5), the load on the hydraulic pump can be reduced reliably during cold engine start-up, thereby improving the engine start-up performance.

Effect of the Invention

In accordance with the invention, even during cold engine start-up, it is possible to prevent a response lag of load sensing control and a decrease in the responsiveness of an unloading valve which are attributable to a viscosity rise in the working fluid and thereby also prevent a pressure increase inside a hydraulic fluid supply line. It is therefore possible to reduce the load on a hydraulic pump and improve the engine start-up performance during cold engine start-up.

It is further possible to reduce the load on the hydraulic pump during cold engine start-up without compromising the anti-hunting characteristics of the unloading valve, thereby improving the engine start-up performance.

MODE FOR CARRYING OUT THE INVENTION

An embodiment of the present invention will now be described with reference to the accompanying drawings.

—Configuration—

<Overall Configuration>

Figure 1:
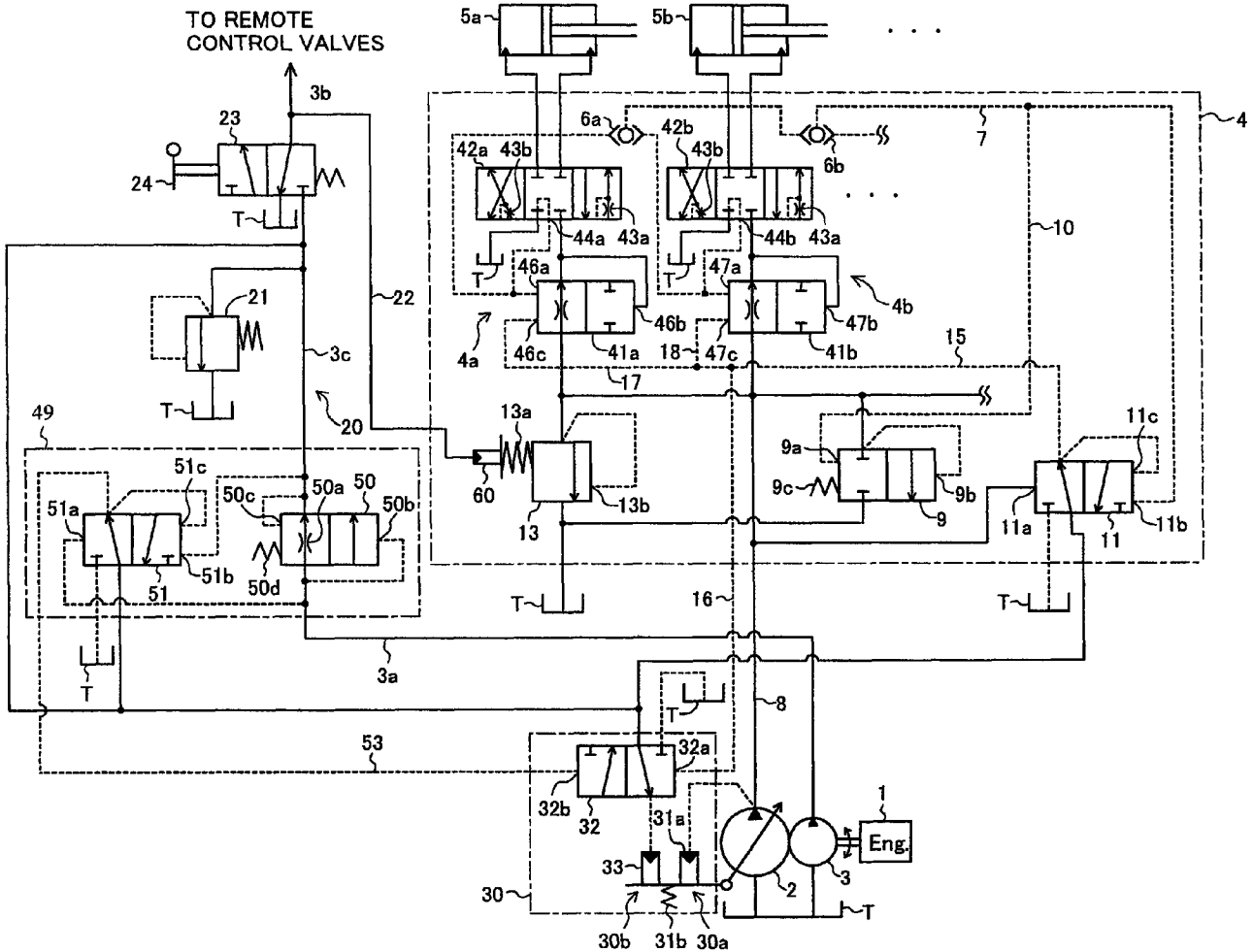
FIG. 1 is a diagram illustrating the overall configuration of a hydraulic drive system for a construction machine according to an embodiment of the invention.

FIG. 1 is a circuit diagram of a hydraulic drive system according to the embodiment of the invention.

The hydraulic drive system of FIG. 1 comprises the following components: an engine 1; a variable displacement hydraulic pump 2, the main pump driven by the engine 1; a fixed displacement pilot pump 3; a control valve block 4; and multiple actuators 5*a*, 5*b*, . . . that are driven by the pressurized hydraulic fluid these actuators receive from the hydraulic pump 2 through the control valve block 4.

The control valve block 4 comprises the following components: multiple valve sections 4*a*, 4*b*, . . . ; shuttle valves 6*a*, 6*b*, . . . ; an unloading valve 9; a main relief valve 13; and a differential-pressure detecting valve 11. The valve sections 4*a*, 4*b*, . . . include, respectively, pressure compensating valves 41*a*, 41*b*, . . . and flow control valves (main spools) 42*a*, 42*b*, . . . , all of which are connected to a hydraulic fluid supply line 8 through which the pressurized hydraulic fluid flows from the hydraulic pump 2 and control the flow (i.e., flow rate and direction) of the pressurized hydraulic fluid supplied from the pump 2 to the actuators 5*a*, 5*b*, . . . . The shuttle valves 6*a*, 6*b*, . . . are connected, respectively, to the load ports 44*a*, 44*b*, . . . (described later) of the flow control valves 42*a*, 42*b*, . . . and detect the highest pressure from among those of the load ports 44*a*, 44*b*, . . . . Specifically, when the actuators 5*a*, 5*b*, . . . are in operation, the shuttle valves 6*a*, 6*b*, . . . detect the highest load pressure (maximum load pressure Plmax) from among those of the actuators 5*a*, 5*b*, . . . ; when those are not in operation, the shuttle valves 6*a*, 6*b*, . . . detect the pressure of a tank T. The shuttle valves 6*a*, 6*b*, . . . output the detected pressure as a signal pressure to a signal pressure hydraulic line 7. The unloading valve 9, also connected to the hydraulic fluid supply line 8, controls the discharge pressure of the hydraulic pump 2. Specifically, when the discharge pressure of the pump 2 is higher by more than a given amount (i.e., target differential pressure) than the signal pressure of the signal pressure hydraulic line 7 (i.e., than the maximum load pressure Plmax when the actuators 5*a*, 5*b*, . . . are in operation or than the tank pressure when the actuators 5*a*, 5*b*, . . . are not in operation), then, the unloading valve 9 opens to return the hydraulic fluid discharged from the pump 2 to the tank T, so that the discharge pressure of the pump 2 cannot be higher than the signal pressure by more than the target differential pressure. The main relief valve 13, also connected to the hydraulic fluid supply line 8, is adapted to limit the maximum pressure in the hydraulic fluid supply line 8 to a first pressure (described later) or below. Specifically, when the discharge pressure of the hydraulic pump 2 is higher than the first pressure (set as a relief pressure), the main relief valve 13 opens to return the hydraulic fluid discharged from the pump 2 to the tank T. The differential-pressure detecting valve 11 outputs as an absolute pressure the differential pressure between the discharge pressure of the hydraulic pump 2 and the signal pressure of the signal pressure hydraulic line 7, that is, the differential pressure between the discharge pressure of the pump 2 and the maximum load pressure Plmax (LS differential pressure) when the actuators 5*a*, 5*b*, . . . are in operation or the differential pressure between the discharge pressure of the pump 2 and the tank pressure when the actuators 5*a*, 5*b*, . . . are not in operation.

The hydraulic pump 2 is provided with a pump-tilting control mechanism 30 for controlling the tilting amount (i.e., displacement volume) of the pump 2. The pump-tilting control mechanism 30 includes a torque tilting control unit 30*a* and an LS tilting control unit 30*b*. The torque tilting control unit 30*a* decreases the tilting amount (hereinafter referred to as "tilting", as needed) of the hydraulic pump 2 when the discharge pressure of the pump 2 is high, thereby decreasing the discharge amount of the pump 2. The LS tilting control unit 30*b* controls the tilting of the hydraulic pump 2 by load sensing such that the discharge pressure of the pump 2 becomes higher by a given amount (i.e., target differential pressure) than the signal pressure of the signal pressure hydraulic line 7 (i.e., than the maximum load pressure Plmax when the actuators 5*a*, 5*b*, . . . are in operation or than the tank pressure when the actuators 5*a*, 5*b*, . . . are not in operation).

The torque tilting control unit 30*a* includes a torque control actuator 31*a* and a spring 31*b*. The torque control actuator 31*a* receives the discharge pressure of the hydraulic pump 2 and operates to decrease the tilting of the pump 2. The spring 31*b*, on the other hand, operates to increase the tilting of the hydraulic pump 2. When the discharge pressure of the hydraulic pump 2 is high enough for the torque of the pump 2 to exceed the maximum permissible torque the spring 31*b* can absorb, the torque control actuator 31*a* reduces the tilting of the pump 2 to decrease the discharge amount of the pump 2, so that the torque of the pump 2 cannot exceed the maximum permissible torque for the spring 31*b*.

The LS tilting control unit 30*b* includes an LS control valve 32 and an LS control actuator 33. The LS control valve 32 generates a control pressure to be supplied to the LS control actuator 33, based on a primary pilot pressure from a primary pilot pressure generator 20, described later. The LS control actuator 33 controls the tilting of the hydraulic pump 2 in response to the control pressure.

The LS control valve 32 has a pressure receiver 32*a* located on the side in which the control pressure is increased to reduce the tilting of the hydraulic pump 2 and also has a pressure receiver 32*b* located on the side in which the control pressure is decreased to increase the tilting of the pump 2. Supplied to the pressure receiver 32*a* is the output pressure of the differential-pressure detecting valve 11, that is, the differential pressure between the discharge pressure of the hydraulic pump 2 and the maximum load pressure Plmax (LS differential pressure) when the actuators 5*a*, 5*b*, . . . are in operation or the differential pressure between the discharge pressure of the pump 2 and the tank pressure when the actuators 5*a*, 5*b*, . . . are not in operation (the latter differential pressure is equal to the discharge pressure of the hydraulic pump 2 when the tank pressure is assumed to be zero). Supplied to the pressure receiver 32*b* is the output pressure of an engine revolution counter circuit 49, described later. Based on the output pressure of the engine revolution counter circuit 49, the pressure receiver 32*b* sets a target differential pressure for load sensing control to 1.5 MPa, for example.

When the output pressure of the differential-pressure detecting valve 11 received by the pressure receiver 32*a* is higher than the target differential pressure for load sensing control determined by the pressure receiver 32*b* based on the output pressure of the engine revolution counter circuit 49, the LS control valve 32 increases the control pressure to decrease the tilting of the hydraulic pump 2, thereby reducing the discharge amount (hence the discharge pressure) of the hydraulic pump 2. Conversely, when the foregoing output pressure of the differential-pressure detecting valve 11 received by the pressure receiver 32*a* is lower than the target differential pressure for load sensing control determined by the pressure receiver 32*b* based on the output pressure of the engine revolution counter circuit 49, the LS control valve 32 decreases the control pressure to increase the tilting of the hydraulic pump 2, thereby increasing the discharge amount (hence the discharge pressure) of the pump 2. Accordingly, the LS control valve 32 controls the tilting of the hydraulic pump 2 such that when the actuators 5*a*, 5*b*, . . . are in operation, the LS differential pressure becomes equal to the target differential pressure (that is, the discharge pressure of the pump 2 becomes higher than the maximum load pressure Plmax by the target differential pressure) and such that when the actuators 5*a*, 5*b*, . . . are not in operation, the discharge pressure of the pump 2 becomes equal to the target differential pressure (that is, the discharge pressure of the pump 2 becomes higher than the tank pressure, which is approximately zero, by the target differential pressure).

The flow control valves 42*a*, 42*b*, . . . are valves of the closed center type and can be actuated by operation of the respective control levers not illustrated, and the operation amount of each of the control levers determines the opening area of meter-in throttle 43*a* or 43*b*. As stated above, the flow control valves 42*a*, 42*b*, . . . include the load ports 44*a*, 44*b*, . . . , respectively. When the actuators 5*a*, 5*b*, . . . are in operation (that is, when the flow control valves 42*a*, 42*b*, . . . are in operation), the load ports 44*a*, 44*b*, . . . communicate with the downstream side of the meter-in throttles 43*a* or 43*b*, so that the load pressures of the actuators 5*a*, 5*b*, . . . are extracted to the load ports 44*a*, 44*b*, . . . , respectively. When the actuators 5*a*, 5*b*, . . . are not in operation (that is, when the flow control valves 42*a*, 42*b*, . . . are not in operation or are in neutral position), the load ports 44*a*, 44*b*, . . . communicate with the tank T, so that the tank pressure is extracted to the load ports 44*a*, 44*b*, . . . .

The pressure compensating valves 41*a*, 41*b*, . . . are the upstream type compensating valves that are installed upstream of the meter-in throttles 43*a* or 43*b* of the flow control valves 42*a*, 42*b*, . . . for controlling the differential pressures across the meter-in throttles 43*a* or 43*b* of the flow control valves 42*a*, 42*b*, . . . . The pressure compensating valve 41*a* has a pressure receiver 46*a* located on the valve-closing side and a pressure receiver 46*b* located on the valve-opening side, with the pressure receivers 46*a* and 46*b* facing each other, and also has a pressure receiver 46*c* located on the valve-opening side. Supplied to the pressure receivers 46*a* and 46*b* are the upstream pressure and the downstream pressure, respectively, of the meter-in throttle 43*a* or 43*b* of the flow control valve 42*a*. Supplied to the pressure receiver 46*c* is the output pressure of the differential-pressure detecting valve 11, that is, the differential pressure between the discharge pressure of the hydraulic pump 2 and the maximum load pressure Plmax (LS differential pressure) when the actuators 5*a*, 5*b*, . . . are in operation or the differential pressure between the discharge pressure of the pump 2 and the tank pressure when the actuators 5*a*, 5*b*, . . . are not in operation. Using the output pressure of the differential-pressure detecting valve 11 as a target compensatory differential pressure, the pressure compensating valve 41*a* controls the differential pressure across the flow control valve 42*a*. Likewise, the pressure compensating valve 41*b* includes pressure receivers 47*a*, 47*b*, and 47*c* and is structurally the same as the pressure compensating valve 41*a*. The rest of the pressure compensating valves also have the same configuration as the pressure compensating valves 41*a* and 41*b*. With the above configuration of the pressure compensating valves 41*a*, 41*b*, . . . , the differential pressures across the meter-in throttles 43*a* or 43*b* of the flow control valves 42*a*, 42*b*, . . . are controlled to the same level, and the pressurized hydraulic fluid can be supplied in proportion to the opening areas of the meter-in throttles of the flow control valves 42*a*, 42*b*, . . . , regardless of how large or small the load pressure is. Moreover, by using the output pressure of the differential-pressure detecting valve 11 (i.e., the LS differential pressure between the discharge pressure of the hydraulic pump 2 and the maximum load pressure Plmax when the actuators 5*a*, 5*b*, . . . are in operation or the differential pressure between the discharge pressure of the pump 2 and the tank pressure when the actuators 5*a*, 5*b*, . . . are not in operation) as the target compensatory differential pressure to control the differential pressure across the flow control valve 42*a*, the pressurized hydraulic fluid can be supplied in proportion to the opening areas of the meter-in throttles 43*a* or 43*b* of the flow control valves 42*a*, 42*b*, . . . even if the discharge amount of the pump 2 is below the demanded flow rate, i.e., in a saturated state.

The unloading valve 9 has a pressure receiver 9*a* and spring 9*c* located on the valve-closing side and a pressure receiver 9*b* located on the valve-opening side, with the pressure receivers 9*a* and 9*b* facing each other. The pressure receiver 9*a* is connected to the signal pressure hydraulic line 7 via a signal pressure hydraulic line 10. The pressure receiver 9*a* receives the signal pressure detected by the shuttle valves 6*a*, 6*b*, . . . (i.e., the maximum load pressure Plmax when the actuators 5*a*, 5*b*, . . . are in operation or the tank pressure when the actuators 5*a*, 5*b*, . . . are not in operation) while the pressure receiver 9*b* receives the discharge pressure of the hydraulic pump 2, i.e., the pressure of the hydraulic fluid supply line 8. The pressure receiver 9*a* has an area of Aa, and the pressure receiver 9*b* an area of Ab, where Aa is equal to Ab. The spring 9*c* sets a target differential pressure for the unloading valve 9 to 2.0 MPa, for example. With the above configuration, the unloading valve 9 opens to return the hydraulic fluid discharged from the hydraulic pump 2 to the tank T when the discharge pressure of the pump 2 is higher than the signal pressure of the signal pressure hydraulic line 7 (i.e., than the maximum load pressure Plmax when the actuators 5*a*, 5*b*, . . . are in operation or than the tank pressure when the actuators 5*a*, 5*b*, . . . are not in operation) by more than the target differential pressure set by the spring 9*c*, so that the discharge pressure of the pump 2 cannot be higher than the signal pressure by more than the target differential pressure.

The main relief valve 13 includes a spring 13*a* located on the valve-closing side and a pressure receiver 13*b* located on the valve-opening side. The pressure receiver 13*b* receives the discharge pressure of the hydraulic pump 2 (i.e., the pressure of the hydraulic fluid supply line 8). When the discharge pressure of the pump 2 exceeds the relief pressure set by the spring 13*a*, the main relief valve 13 opens to return the pressurized hydraulic fluid inside the hydraulic fluid supply line 8 to the tank T, so that the discharge pressure of the pump 2 cannot exceed the relief pressure. The main relief valve 13 is also provided with a biasing force altering unit 60, described later, for changing the biasing force of the spring 13*a* to switch the relief pressure of the main relief valve 13 between a first pressure (a standard pressure of, for example, 25 MPa) and a second pressure for engine start-up (e.g., 3 MPa).

The differential-pressure detecting valve 11 has a pressure receiver 11*a* located on the pressure-increasing side and pressure receivers 11*b* and 11*c* located on the pressure-reducing side. The pressure receiver 11*a* receives the discharge pressure of the hydraulic pump 2 while the pressure receivers 11*b* and 11*c* receive, respectively, the signal pressure of the signal pressure hydraulic line 7 and the output pressure of the differential-pressure detecting valve 11. Exploiting the balance among those pressures and using the primary pilot pressure from the primary pilot pressure generator 20 (described later), the differential-pressure detecting valve 11 generates and outputs as an absolute pressure the differential pressure between the discharge pressure of the hydraulic pump 2 and the signal pressure of the signal pressure hydraulic line 7.

The output port of the differential-pressure detecting valve 11 is connected to the pressure receiver 32*a* of the LS control valve 32 of the pump-tilting control mechanism 30 via signal pressure hydraulic lines 15 and 16, so that the output pressure of the differential-pressure detecting valve 11 can be supplied to the pressure receiver 32*a*. The output port of the differential-pressure detecting valve 11 is connected also to the pressure receivers 46*c*, 47*c*, . . . of the pressure compensating valves 41*a*, 41*b*, . . . via the signal pressure hydraulic line 15 and signal pressure hydraulic lines 17 and 18, so that the output pressure of the differential-pressure detecting valve 11 can be supplied to the pressure receivers 46*c*, 47*c*, . . . as the target compensatory differential pressure.

The actuators 5*a*, 5*b*, . . . could be boom cylinders, arm cylinders, or the like for a hydraulic excavator. A hydraulic excavator according to the invention also has other actuators including a swing motor, right and left travelling cylinders, a bucket cylinder, and the like. FIG. 1 omits the illustration of those actuators and their associated circuits in the control valve block 4.

The hydraulic drive system of the present embodiment includes the engine revolution counter circuit 49 and the primary pilot pressure generator 20 as stated above and further includes a gate lock valve 23.

The engine revolution counter circuit 49 includes a flow-rate detecting valve 50 and a differential-pressure detecting valve 51. The flow-rate detecting valve 50 includes a variable throttle 50*a*. The upstream side of the throttle 50*a* is connected to a discharge hydraulic line 3*a* that extends from the pilot pump 3 while the downstream side of the throttle 50*a* is connected to a hydraulic line 3*c* that extends from the primary pilot pressure generator 20.

The flow-rate detecting valve 50 detects the discharge amount of the pilot pump 3 as a change of differential pressure across the throttle 50*a*. Because the discharge amount of the pilot pump 3 varies with changes of the revolving speed of the engine 1, detecting the discharge amount of the pilot pump 3 allows detection of the revolving speed of the engine 1. For instance, a decrease in the revolving speed of the engine 1 leads to a decrease in the discharge amount of the pilot pump 3 and also to a decrease in differential pressure across the throttle 50*a*.

The variable throttle 50*a* is configured such that its orifice area changes in a continuous manner. The flow-rate detecting valve 50 further includes a pressure receiver 50*b*, which operates to open the valve 50, and a pressure receiver 50*c* and spring 50*d*, which operate to reduce the orifice area of the valve 50. The pressure receiver 50*b* receives the upstream pressure of the throttle 50*a* (i.e., the pressure of the discharge hydraulic line 3*a*) while the pressure receiver 50*c* receives the downstream pressure of the throttle 50*a* (i.e., the pressure of the hydraulic line 3*c*). The throttle 50*a* changes its own orifice area when the differential pressure across the throttle 50*a* changes.

The differential-pressure detecting valve 51 outputs as an absolute pressure the differential pressure across the throttle 50*a*, which changes in response to the engine revolving speed, whereby the engine speed can be detected. The differential-pressure detecting valve 51 has a pressure receiver 51*a* located on the pressure-increasing side and pressure receivers 51*b* and 51*c* located on the pressure-reducing side. The pressure receiver 51*a* receives the upstream pressure of the throttle 50*a* while the pressure receivers 51*b* and 51*c* receive, respectively, the downstream pressure of the throttle 50*a* and the output pressure from the differential-pressure detecting valve 51. Exploiting the balance among those pressures and using the primary pilot pressure from the primary pilot pressure generator 20, the differential-pressure detecting valve 51 generates and outputs as an absolute pressure the differential pressure across the throttle 50*a*.

The output port of the differential-pressure detecting valve 51 is connected to the pressure receiver 32*b* of the LS control valve 32 via a signal pressure hydraulic line 53, so that the output pressure of the differential-pressure detecting valve 51 can be supplied to the pressure receiver 32*b* as the target differential pressure for load sensing control. By thus directing the differential pressure across the throttle 50*a* to the pressure receiver 32*b* of the LS control valve 32 and setting that differential pressure as the target differential pressure for load sensing control, saturation phenomena can be overcome on an engine-speed basis. This leads also to finer and more precise machine maneuverability when the engine revolving speed is low. JP-10-196604-A has a detailed description of the above.

The primary pilot pressure generator 20 includes a pilot relief valve 21 connected to the hydraulic line 3*c*. The pilot relief valve 21 maintains the pressure in the hydraulic line 3*c* at a fixed value (e.g., 4.0 MPa), thereby generating the primary pilot pressure. The downstream side of the hydraulic line 3*c* is connected to a primary pilot pressure hydraulic line 3*b* via the gate lock valve 23. Also connected to the primary pilot pressure hydraulic line 3*b* are remote control valves (not illustrated) that are actuated by the above-mentioned control levers and generates, based on the pressure from the primary pilot pressure generator 20 (i.e., the primary pilot pressure), control pilot pressures for controlling the respective flow control valves 42*a*, 42*b*, . . . .

The gate lock valve 23 is positioned between the hydraulic line 3*c* and the primary pilot pressure hydraulic line 3*b* and controlled by a gate lock lever 24 located at the cab entrance of the hydraulic excavator. The gate lock lever 24 is operated between the lock position (OFF position) that allows the operator to get in/out of the cab and the unlock position (ON position) that does not allow the operator to do so. When the gate lock lever 24 is placed in the lock position (OFF), the gate lock valve 23 is also placed in that position (i.e., moved to the right of FIG. 1). The lock position disconnects the hydraulic line 3*c* from the primary pilot pressure hydraulic line 3*b* and connects the primary pilot pressure hydraulic line 3*b* to the tank T. When, on the other hand, the gate lock lever 24 is placed in the unlock position (ON), the gate lock valve 23 is also placed in that position (i.e., moved to the left of the FIG. 1). The unlock position connects the hydraulic line 3*c* to the primary pilot pressure hydraulic line 3*b*.

In the present embodiment, the biasing force altering unit 60 for the main relief valve 13 is connected to the primary pilot pressure hydraulic line 3*b* via a hydraulic line 22. When the gate lock valve 23 is in the unlock position, the biasing force altering unit 60 sets the relief pressure to the first pressure (a standard pressure of, for example, 25 MPa). When the gate lock valve 23 is in the lock position, the biasing force altering unit 60 sets the relief pressure to the second pressure for engine start-up (e.g., 3 MPa).

The biasing force altering unit 60, the gate lock valve 23, and the gate lock lever 24 constitute relief pressure altering means for manually (with the use of the gate lock lever 24) switching the relief pressure of the main relief valve 13 between the first pressure (a standard pressure of, for example, 25 MPa) and the second pressure for engine start-up (e.g., 3.0 MPa) that is lower than the first pressure and allows the main relief valve 13 to return the hydraulic fluid discharged from the hydraulic pump 2 to the tank in conjunction with the unloading valve 9 when the actuators 5*a*, 5*b*, . . . are not in operation.

The pilot pump 3 and the primary pilot pressure generator 20 constitute a pilot hydraulic fluid source. The gate lock valve 23 constitutes valve means for selectively connecting the hydraulic fluid chamber 69 of the biasing force altering unit 60 (described later) to the pilot hydraulic fluid source and to the tank T. The gate lock lever 24 constitutes manual control means for controlling the valve means (i.e., the gate lock valve 23).

The second pressure for engine start-up is set low to such an extent that when the actuators 5*a*, 5*b*, . . . are not in operation (when the flow control valves 42*a*, 42*b*, . . . are all in neutral position) under the ambient temperature below the freezing point, the main relief valve 13 can open to return the hydraulic fluid discharged from the hydraulic pump 2 to the tank T in conjunction with the unloading valve 9. Preferably, the second pressure is higher than a pressure equivalent to the target differential pressure for load sensing control (e.g., higher than 1.5 MPa) and smaller than double the pressure set for the unloading valve 9 (e.g., smaller than 4.0 MPa (2.0 MPa times 2)).

<Detailed Structure of the Main Relief Valve 13>

Figure 2:
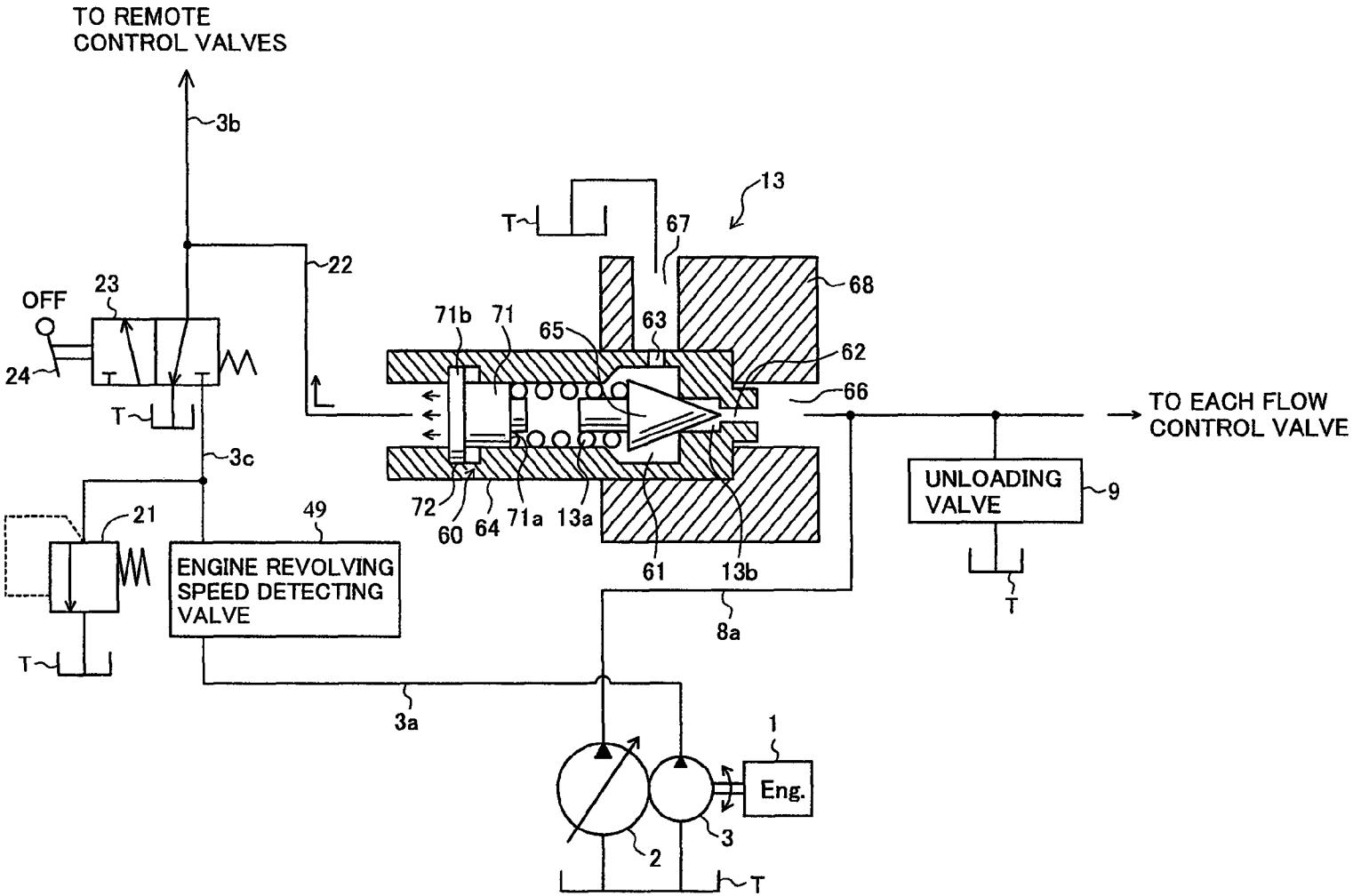
FIG. 2 is a diagram of a main relief valve and its nearby circuit components, particularly illustrating the states of the main relief valve and of a biasing force altering unit when a gate lock valve is in lock position.
Figure 3:
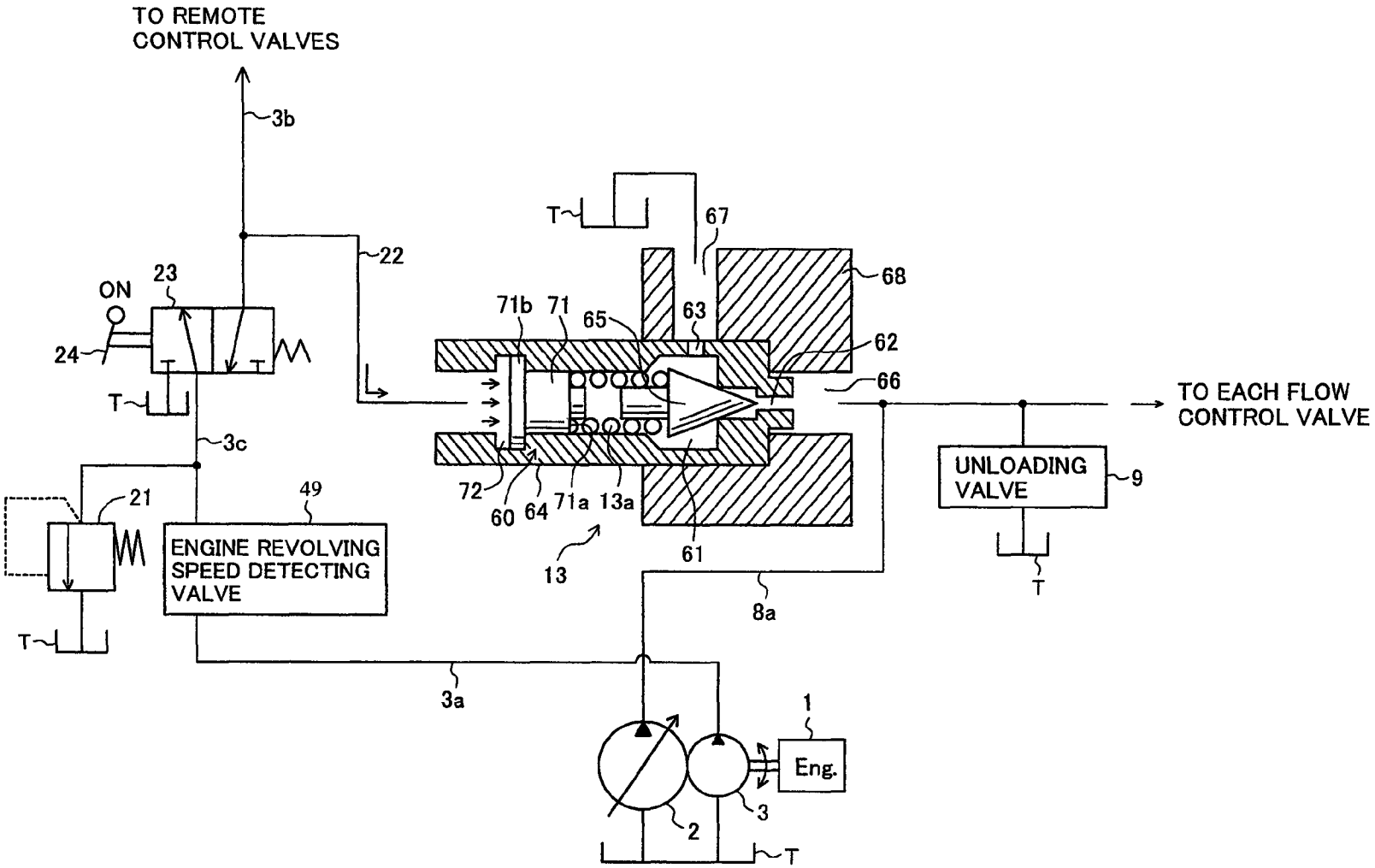
FIG. 3 is a diagram of the main relief valve and its nearby circuit components, particularly illustrating the states of the main relief valve and of the biasing force altering unit when the gate lock valve is in unlock position.

FIGS. 2 and 3 are diagrams of the main relief valve 13 and its nearby circuits of FIG. 1, illustrating in greater detail the main relief valve 13 and the biasing force altering unit 60. In FIG. 2, the gate lock valve 23 is in the lock position (OFF), and the second pressure for engine start-up is set as the relief pressure. In FIG. 3, conversely, the gate lock valve 23 is in the unlock position (ON), and the first pressure, i.e., the standard pressure, is set as the relief pressure.

The main relief valve 13 comprises the following components: a housing 64; a valve body 65; and a support 70. The housing 64 has a valve chamber 61 therein and an input port 62 and an output port 63 therethrough. The valve body 65 is located inside the housing 64 and used to open or close the input port 62. The support 70 has an inlet 66 that communicates with the input port 62 and an outlet 67 that communicates with the output port 63 and is used to secure the housing 64. The above-mentioned spring 13*a* of the main relief valve 13 is installed inside the housing 64 in such a way as to bias the valve body 65 in the valve-closing direction. The pressure receiver 13*b*, mentioned above, of the relief valve 13 is installed on the downstream side of the input port 62 where the valve body 65 is seated. The inlet 66 is connected to the hydraulic fluid supply line 8 while the outlet 67 is connected to the tank T.

The biasing force altering unit 60 is installed behind the spring 13*a* located inside the housing 64. The biasing force altering unit 60 includes a piston 68 and the hydraulic fluid chamber 69, mentioned above. The piston 68 is installed inside the housing 64 such that the piston 68 can move in axial directions of the housing 64 (to the right and left of FIG. 2). The hydraulic fluid chamber 69 is formed on the side of the piston 68 that is opposite the spring 13*a*. One end of the piston 68 is provided with a spring support 68*a* that supports the proximal end of the spring 13*a* while the other end of the piston 68 is provided with a radially expanded portion 68*b* that acts as a pressure receiver inside the hydraulic fluid chamber 69. The radially expanded portion 68*b* is capable of moving inside the hydraulic fluid chamber 69 based on a predetermined stroke length. The hydraulic fluid chamber 69 is connected to the primary pilot pressure hydraulic line 3*b* via the hydraulic line 22.

As illustrated in FIG. 2, when the gate lock valve 23 is in the lock position (OFF) and the primary pilot pressure hydraulic line 3*b* is connected to the tank T, the hydraulic fluid chamber 69 also communicates with the tank T. Further, pressing of the piston 68 by the spring 13*a* causes the radially expanded portion 68*b* of the piston 68 to move to the left of FIG. 2 inside the hydraulic fluid chamber 69. At this time, the spring 13*a* is expanded in length, and its force is kept weak. Thus, when the gate lock valve 23 is in the lock position, the relief pressure of the main relief valve 13 is set to the second pressure for engine start-up (e.g., 3.0 MPa), which is lower than the first pressure (the standard pressure, e.g., 25 MPa).

As illustrated in FIG. 3, when the gate lock valve 23 is in the unlock position (ON) and the primary pilot pressure hydraulic line 3*b* is connected to the hydraulic line 3*c*, the primary pilot pressure in the hydraulic line 3*c* is introduced into the hydraulic fluid chamber 69. The primary pilot pressure then presses the radially expanded portion 68*b* of the piston 68, moving the piston 68 to the right of FIG. 3. At this time, the spring 13*a* is contracted in length, and its force is kept strong. Thus, when the gate lock valve 23 is in the unlock position, the relief pressure of the main relief valve 13 is set to the first pressure (the standard pressure, e.g., 25 MPa).

<Structure of the Hydraulic Excavator>

Figure 4:
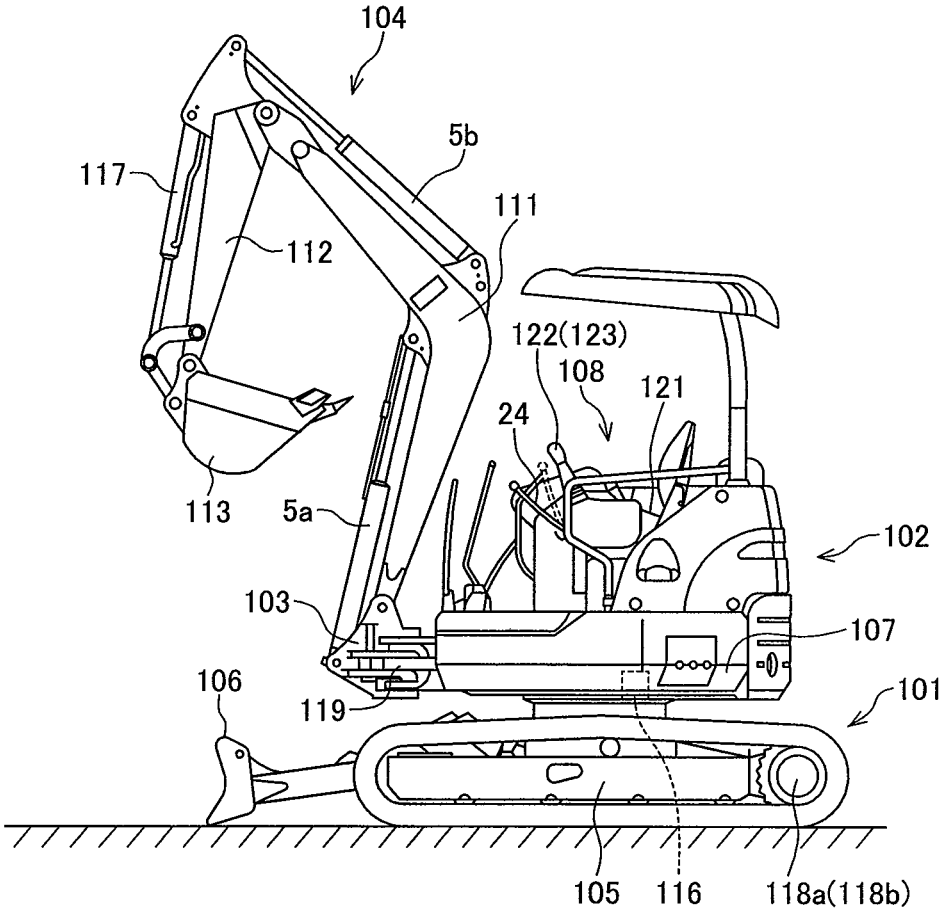
FIG. 4 is an external view of a hydraulic excavator on which the hydraulic drive system of the embodiment is mounted.

FIG. 4 is an external view of a hydraulic excavator on which the hydraulic drive system of the present embodiment is mounted. The hydraulic excavator comprises the following main components: a lower travel structure 101; an upper swing structure 102; and a front work device 104. The upper swing structure 102 is mounted on the lower travel structure 101 in a swingable manner. The front work device 104 is attached via a swing post 103 to the front end of the upper structure 102 in a vertically and horizontally movable manner. The lower travel structure 101 is provided with crawler belts. A soil removal blade 106 is attached to the front side of a track frame 105 in a vertically movable manner. The upper swing structure 102 includes a swing body 107, or a lower base structure, and a canopy-attached cab 108 installed on the swing body 107. The front work device 104 includes a boom 111, an arm 112, and a bucket 113. The proximal end of the boom 111 is pinned to the swing post 103 while the distal end of the boom 111 is pinned to the proximal end of the arm 112. The distal end of the arm 112 is pinned to the bucket 113.

The boom 111 and the arm 112 are moved by expanding or contracting a boom cylinder 5*a* and an arm cylinder 5*b* (the boom cylinder 5*a* and the arm cylinder 5*b* correspond to the actuators 5*a* and 5*b*, respectively, of FIG. 1). The upper swing structure 102 is swung by rotating a swing motor 116. The bucket 113 is moved by expanding or contracting a bucket cylinder 117 while the blade 106 is moved vertically by expanding or contracting a blade cylinder not illustrated.

The lower travel structure 101 travels by the rotation of left and right travel motors 118*a* and 118*b* while the swing post 103 rotates by the expansion or contraction of a swing cylinder 119. The hydraulic circuit diagram of FIG. 1 omits the illustration of such actuators as the swing motor 116, bucket cylinder 117, travel motors 118*a* and 118*b*, swing cylinder 119, and the like.

Inside the cab 108 is a cab seat 121 on which the operator is seated. Installed on the right and left sides of the cab seat 121 are, respectively, a control lever device 122 having bucket/boom control levers and a control lever device 123 having swing/arm control levers. Also, the gate lock lever 24 is installed at the entrance of the cab seat 121. The solid line of FIG. 4 that depicts the gate lock lever 24 represents the unlock position (ON) at which the operator is not allowed to get in/out of the cab 108. The dashed line of FIG. 4 that depicts the gate lock lever 24 represents the lock position (OFF) at which the operator is allowed to get in/out of the cab 108. Inside the control lever devices 122 and 123 are the remote control valves connected to the primary pilot pressure hydraulic line 3*b* shown in FIGS. 1 to 3.

—Operation—

Described next is the operation of the above hydraulic excavator on which the hydraulic drive system of the present embodiment is mounted.

<When the Gate Lock Lever is in the Lock Position>

After a day's work, the operator turns off a keyed starter switch not illustrated to stop the engine 1. At this time, the operator places the gate lock lever 24 in the lock position for safety purposes, thereby also placing the gate lock valve 23 in the lock position, which position allows the primary pilot pressure hydraulic line 3*b* to communicate with the tank T so that the flow control valves 42*a*, 42*b*, . . . cannot be controlled. When the engine 1 stops, the hydraulic pump 2 does not discharge any pressurized hydraulic fluid; thus, the spring 31*b* of the torque tilting control unit 30*a* works to maximize the tilting of the pump 2.

Before the hydraulic excavator is operated for a day's work, the gate lock lever 24 is in the lock position, and the tilting (i.e., displacement volume) of the hydraulic pump 2 is the largest. Since the gate lock lever 24 is in the lock position and the gate lock valve 23 allows the primary pilot pressure hydraulic line 3*b* to communicate with the tank T, the piston 68 of the biasing force altering unit 60 extends the spring 13*a* and keeps its force weak, as illustrated in FIG. 2. In that case, the relief pressure of the main relief valve 13 is the second pressure for engine start-up (e.g., 3.0 MPa), which is lower than the first pressure (the standard pressure, e.g., 25 MPa).

To start operation of the hydraulic excavator for a day's work, the operator first turns on the keyed starter switch, not illustrated, thereby starting the engine 1. Right after the engine start-up, the LS control valve 32 starts to control the tilting (displacement volume) of the hydraulic pump 2 (i.e., perform load sensing control) such that the signal pressure received by the pressure receiver 32*a* from the signal pressure hydraulic line 16 is equal to a target differential pressure set by the pressure receiver 32*b* (e.g., 1.5 MPa). Because, right after the start-up, the control levers are not operated and the flow control valves 42*a*, 42*b*, . . . are thus in neutral position, the signal pressure from the signal pressure hydraulic line 7 (i.e., the output pressure of the shuttle valves 6*a*, 6*b*, . . . ) is the tank pressure, and the signal pressure from the signal pressure hydraulic line 16 (i.e., the output pressure of the differential-pressure detecting valve 11) is approximately equal to the discharge pressure of the hydraulic pump 2. Since the tilting of the hydraulic pump 2 is the largest right after the start-up of the engine 1, the discharge pressure of the hydraulic pump 2 will increase transiently, exceeding the target differential pressure for load sensing control. Therefore, the LS control valve 32 reduces the tilting of the hydraulic pump 2 from the largest to the smallest so that the discharge pressure of the pump can be equal to the target differential pressure, thereby reducing the discharge amount of the pump 2 to a minimum possible value but not to zero. The reason for reducing the discharge amount of the pump 2 to the minimum possible value, but not to zero, even when the flow control valves 42*a*, 42*b*, . . . are in neutral position without the control levers being operated is to increase the responsiveness of the actuators when the control levers are operated to move the flow control valves 42*a*, 42*b*, . . . from the neutral position.

Thus controlling the tilting (discharge amount) of the hydraulic pump 2 allows the unloading valve 9 to open to return the hydraulic fluid discharged from the hydraulic pump 2 (i.e., the pressurized hydraulic fluid inside the hydraulic fluid supply line 8) to the tank when the discharge pressure of the pump 2 exceeds the pressure set for the unloading valve 9 (i.e., target differential pressure).

When the ambient temperature is below the freezing point (e.g., as low as −10 degrees Celsius), the working fluid is considerably high in viscosity during engine start-up. In such a case, the responsiveness of the unloading valve 9 decreases, and it will take more time for the unloading valve 9 to open, causing high pressure to be stuck inside the hydraulic fluid supply line 8. The viscosity increase of the working fluid also affects load sensing control, causing a response lag. During this response lag, the discharge amount of the hydraulic pump 2 becomes excessively high. As a result, the pressure in the hydraulic fluid supply line 8 (the discharge pressure of the hydraulic pump) becomes high and may occasionally reach as high as 10 MPa. For this reason, the load on the hydraulic pump 2 (hence the load on the engine 1) is conventionally too high, affecting engine start-up.

In the present embodiment, however, when the gate lock lever 24 is in the lock position (OFF), the relief pressure of the main relief valve 13 is set, as stated above, to the second pressure for engine start-up (e.g., 3.0 MPa), which is lower than the first pressure (the standard pressure, e.g., 25 MPa). Consequently, when the discharge pressure of the hydraulic pump 2 reaches the lower second pressure, the main relief valve 13 starts to open, thereby returning the hydraulic fluid discharged from the pump 2 to the tank.

By thus allowing the main relief valve 13 to open besides the unloading valve 9, the discharge pressure of the hydraulic pump 2 can be prevented from becoming excessively high especially when the ambient temperature is low, whereby engine start-up performance can be improved.

If the engine start-up second pressure for the main relief valve 13 is set lower than a pressure equivalent to the target differential pressure for load sensing control (e.g., lower than 1.5 MPa), the LS tilting control unit 30*b* (load sensing control means) controls the displacement volume of the hydraulic pump 2 in such a way as to maximize it, which increases fuel consumption. In the present embodiment, by contrast, the second pressure for the main relief valve 13 is set higher than a pressure equivalent to the target differential pressure for load sensing control. Thus, the load sensing control means is prevented from maximizing the displacement volume of the hydraulic pump 2, which leads to less fuel consumption.

Further, if the second pressure for the main relief valve 13 is set higher than double the pressure set for the unloading valve 9, the load on the hydraulic pump 2 during engine start-up may not be reduced greatly when the ambient temperature is lower than −10 degrees Celsius. In the present embodiment, by contrast, the second pressure for the main relief valve 13 is set lower than double the pressure set for the unloading valve 9 and set, for example, to 3.0 MPa or thereabout, which is approximately 1.5 times the pressure set for the unloading valve 9. Thus, even when the ambient temperature is lower than −10 degrees Celsius, the load on the hydraulic pump 2 can be reduced reliably, thereby improving engine start-up performance.

<When the Gate Lock Lever is in the Unlock Position>

When the operator places the gate lock lever 24 in the unlock position (ON) after the engine start-up, the gate lock valve 23 is also switched to the unlock position, thereby connecting the discharge hydraulic line 3*a* of the pilot pump 3 to the primary pilot pressure hydraulic line 3*b*. Further, the piston 68 of the biasing force altering unit 60 contracts the spring 13*a* and keeps its force strong as illustrated in FIG. 3, and the first pressure (the standard pressure, e.g., 25 MPa) is set as the relief pressure of the main relief valve 13.

Unless the control levers are operated after the placement of the gate lock lever 24 in the unlock position, the LS control valve 32 continues to minimize the tilting of the hydraulic pump 2 so that the discharge amount of the pump 2 can be a minimum possible value. The discharge pressure of the hydraulic pump 2 is maintained at the pressure set for the unloading valve because the unloading valve 9 opens to return the hydraulic fluid discharged from the pump 2 (the pressurized hydraulic fluid inside the hydraulic fluid supply line 8) to the tank when the discharge pressure of the pump 2 exceeds the pressure set for the unloading valve 9 (e.g., 2.0 MPa). Further, when the gate lock lever 24 is in the unlock position, the relief pressure of the main relief valve 13 is set to the first pressure (the standard pressure, e.g., 25 MPa). Accordingly, the main relief valve 13 does not open unless the discharge pressure of the hydraulic pump 2 reaches the first pressure.

Advantages of the Invention

In accordance with the above-described embodiment of the invention, the relief pressure altering means (the biasing force altering unit 60, the gate lock valve 23, and the gate lock lever 24) is manually operated to switch the relief pressure of the main relief valve 13 from the first pressure (the standard pressure, e.g., 25 MPa) to the second pressure for engine start-up (e.g., 3.0 MPa) which is lower than the first pressure. Thus, the main relief valve 13 is allowed to return the hydraulic fluid discharged from the hydraulic pump 2 to the tank T in conjunction with the unloading valve 9 if the discharge pressure of the pump 2 exceeds the pressure set for the unloading valve 9 (e.g., 2.0 MPa) without the actuators 5*a*, 5*b*, . . . being operated. Consequently, during cold engine start-up, it is possible to prevent a response lag of load sensing control and a decrease in the responsiveness of the unloading valve 9 which are attributable to a viscosity rise in the working fluid and thereby also prevent high pressure from staying inside the hydraulic fluid supply line 8. It is therefore possible to prevent a considerable boost in the discharge pressure of the hydraulic pump 2, reduce the load on the hydraulic pump 2, and improve the start-up performance of the engine 1.

Moreover, since both of the unloading valve 9 and the main relief valve 13 are used to return the hydraulic fluid discharged from the hydraulic pump 2 to the tank T, the responsiveness of the unloading valve 9 need not be increased much, whereby the anti-hunting characteristics of the unloading valve 9 are not compromised.

Further, the gate lock lever 24 (the manual control means) is operated to control the gate lock valve 23 (the valve means), thereby selectively connecting the hydraulic fluid chamber 69 of the biasing force altering unit 60 to the primary pilot pressure generator 20 or to the tank T so that the biasing force of the spring 13*a* can be changed. Therefore, the relief pressure of the main relief valve 13 can be switched easily and reliably between the first pressure and the second pressure.

Furthermore, because the gate lock valve 23 (the valve means) and the gate lock lever 24 (the manual control means) that constitute means for controlling the biasing force altering unit 60 are existing ones, it is possible to achieve a less costly machine configuration with fewer components. In addition, no special control is required to switch the relief pressure of the main relief valve 13 between the first pressure and the second pressure because controlling the gate lock lever 24 to change the state of the gate lock valve 23 changes the state of the biasing force altering unit 60 simultaneously.

The above-described embodiment of the invention can be modified or changed in various forms within the scope of the invention. For instance, while the biasing force altering unit 60 of the above embodiment is hydraulically driven, it can instead be solenoid-driven. In that case, the position of the gate lock lever 24 is detected electrically, and solenoid excitation and non-excitation are controlled. This provides the same advantages as those of the above embodiment (improved engine start-up performance during cold start-up and the like).

Further, while both of the gate lock valve 23 (the valve means) and the gate lock lever 24 (the manual control means) constitute the means for controlling the biasing force altering unit 60 in the above embodiment, it is instead possible to use dedicated valve means and manual control means, in which case, too, the same advantages as those of the above embodiment can be obtained.

In the above embodiment, the target differential pressure for load sensing control is set as a variable that changes in response to the engine revolving speed, based on the output pressure of the engine revolution counter circuit 49, and the target differential pressure for the unloading valve 9 is set as a constant by the spring 9*c*. Alternatively, the target differential pressure for the unloading valve 9 can also be set as a variable that changes in response to the engine revolving speed, based on the output pressure of the engine revolution counter circuit 49.

Furthermore, while the above embodiment has taken the hydraulic excavator as an example of a construction machine, the invention can be applied in the same manner to other construction machines such as cranes, wheel loaders, and the like.

DESCRIPTION OF THE REFERENCE NUMERALS

1: Engine
2: Hydraulic pump (main pump)
3: Pilot pump
3*a*: Discharge hydraulic line
3*b*: Primary pilot pressure hydraulic line
3*c*: Hydraulic line
4: Control valve block
4*a*, 4*b*: Valve section
6*a*, 6*b*: Shuttle valve
7: Signal pressure hydraulic line
8: Hydraulic fluid supply line
9: Unloading valve
9*a*: Pressure receiver
9*b*: Pressure receiver
9*c*: Spring
10: Signal pressure hydraulic line
11: Differential-pressure detecting valve
13: Main relief valve
13*a*: Spring
13*b*: Pressure receiver
15, 16, 17, 18: Signal pressure hydraulic line
20: Primary pilot pressure generator
21: Pilot relief valve
22: Hydraulic line
23: Gate lock valve
24: Gate lock lever
30: Pump-tilting control mechanism
30*a*: Torque tilting control unit
30*b*: LS tilting control unit (Load sensing control means)
31*a*: Torque control actuator
31*b*: Spring
32: LS control valve
32*a*, 32*b*: Pressure receiver
33: LS control actuator
41*a*, 41*b*: Pressure compensating valve
42*a*, 42*b*: Flow control valve (main spool)
43*a*, 43*b*: Meter-in throttle
44*a*, 44*b*: Load port
49: Engine revolving speed detecting circuit
50: Flow-rate detecting valve
51: Differential-pressure detecting valve
60: Biasing force altering unit
61: Valve chamber
62: Input port
63: Output port
64: Housing
65: Valve body
66: Inlet
67: Outlet
68: Piston
69: Hydraulic fluid chamber
68*a*: Spring support
68*b*: Radially expanded portion

The invention claimed is:

1. A hydraulic drive system for a construction machine, the system comprising:

an engine;

a variable displacement hydraulic pump driven by the engine;

a plurality of actuators driven by pressurized hydraulic fluid discharged from the hydraulic pump;

a plurality of flow control valves for controlling the flow rate of the pressurized hydraulic fluid supplied from the hydraulic pump to the actuators;

maximum load pressure detecting means for detecting a maximum load pressure from among the load pressures of the actuators when the actuators are in operation and detecting tank pressure when the actuators are not in operation, thereby outputting the detected pressure as a signal pressure;

load sensing control means for controlling the displacement volume of the hydraulic pump such that the discharge pressure of the hydraulic pump becomes higher than the signal pressure by a target differential pressure;

an unloading valve connected to a hydraulic fluid supply line through which the pressurized hydraulic fluid discharged from the hydraulic pump is supplied to the flow control valves, and operative to open to return the hydraulic fluid discharged from the hydraulic pump to a tank when the discharge pressure of the hydraulic pump is higher than the signal pressure by a pressure set for the unloading valve;

a main relief valve connected to the hydraulic fluid supply line and operative to open to return the hydraulic fluid discharged from the hydraulic pump to the tank when the discharge pressure of the hydraulic pump is higher than a first pressure set as relief pressure, thereby limiting maximum pressure in the hydraulic fluid supply line to the first pressure or below; and relief pressure altering means for manually switching the relief pressure of the main relief valve between the first pressure and a second pressure for engine start-up that is lower than the first pressure and allows the main relief valve to return the hydraulic fluid discharged from the hydraulic pump to the tank in conjunction with the unloading valve when the actuators are not in operation, wherein the main relief valve includes a spring for biasing a valve body of the main relief valve in a valve-closing direction to set the relief pressure of the main relief valve, and the relief pressure altering means comprises:

a biasing force altering unit installed behind the spring of the main relief valve and having a hydraulic fluid chamber for altering the biasing force of the spring by changing a hydraulic pressure in the hydraulic fluid chamber so that the relief pressure of the main relief valve can be switched between the first pressure and the second pressure;

valve means for selectively connecting the hydraulic fluid chamber of the biasing force altering unit to a pilot hydraulic fluid source and to the tank; and manual control means for controlling the valve means.

2. The hydraulic drive system for the construction machine of claim 1, the system further comprising:

a pilot pump;

a primary pilot pressure generator connected to a discharge hydraulic line of the pilot pump for generating a primary pilot pressure based on a hydraulic fluid discharged from the pilot pump;

a primary pilot pressure hydraulic line into which the primary pilot pressure generated by the primary pilot pressure generator is introduced;

a plurality of remote control valves connected to the primary pilot pressure hydraulic line for generating, based on the primary pilot pressure introduced into the primary pilot pressure hydraulic line, control pilot pressures to actuate the respective flow control valves;

a gate lock lever installed at the entrance of a cab and operated between lock position and unlock position; and a gate lock valve installed between the primary pilot pressure generator and the primary pilot pressure hydraulic line for disconnecting the primary pilot pressure generator from the primary pilot pressure hydraulic line and connecting the primary pilot pressure hydraulic line to the tank when the gate lock lever is operated in the lock position and for connecting the primary pilot pressure generator to the primary pilot pressure hydraulic line when the gate lock lever is operated in the unlock position, wherein the pilot hydraulic fluid source comprises the pilot pump and the primary pilot pressure generator, the valve means comprises the gate lock valve, and the manual control means comprises the gate lock lever.

3. The hydraulic drive system for the construction machine of claim 2, wherein the second pressure for engine start-up is higher than a pressure equivalent to the target differential pressure for the load sensing control means and smaller than double the pressure set for the unloading valve.

4. The hydraulic drive system for the construction machine of claim 2, wherein the second pressure for engine start-up is a pressure that allows the main relief valve to open to return the hydraulic fluid discharged from the hydraulic pump to the tank in conjunction with the unloading valve when the actuators are not in operation under an ambient temperature below freezing point.

5. The hydraulic drive system for the construction machine of claim 1, wherein the second pressure for engine start-up is higher than a pressure equivalent to the target differential pressure for the load sensing control means and smaller than double the pressure set for the unloading valve.

6. The hydraulic drive system for the construction machine of claim 1, wherein the second pressure for engine start-up is a pressure that allows the main relief valve to open to return the hydraulic fluid discharged from the hydraulic pump to the tank in conjunction with the unloading valve when the actuators are not in operation under an ambient temperature below freezing point.

7. A hydraulic drive system for a construction machine, the system comprising:

an engine;

a variable displacement hydraulic pump driven by the engine;

a plurality of actuators driven by pressurized hydraulic fluid discharged from the hydraulic pump;

a plurality of flow control valves for controlling the flow rate of the pressurized hydraulic fluid supplied from the hydraulic pump to the actuators;

maximum load pressure detecting means for detecting a maximum load pressure from among the load pressures of the actuators when the actuators are in operation and detecting tank pressure when the actuators are not in operation, thereby outputting the detected pressure as a signal pressure;

load sensing control means for controlling the displacement volume of the hydraulic pump such that the discharge pressure of the hydraulic pump becomes higher than the signal pressure by a target differential pressure;

an unloading valve connected to a hydraulic fluid supply line through which the pressurized hydraulic fluid discharged from the hydraulic pump is supplied to the flow control valves, and operative to open to return the hydraulic fluid discharged from the hydraulic pump to a tank when the discharge pressure of the hydraulic pump is higher than the signal pressure by a pressure set for the unloading valve;

a main relief valve connected to the hydraulic fluid supply line and operative to open to return the hydraulic fluid discharged from the hydraulic pump to the tank when the discharge pressure of the hydraulic pump is higher than a first pressure set as relief pressure, thereby limiting maximum pressure in the hydraulic fluid supply line to the first pressure or below; and relief pressure altering means for manually switching the relief pressure of the main relief valve between the first pressure and a second pressure for engine start-up that is lower than the first pressure and allows the main relief valve to return the hydraulic fluid discharged from the hydraulic pump to the tank in conjunction with the unloading valve when the actuators are not in operation, wherein the second pressure for engine start-up is higher than a pressure equivalent to the target differential pressure for the load sensing control means and smaller than double the pressure set for the unloading valve.

8. A hydraulic drive system for a construction machine, the system comprising:

an engine;

a variable displacement hydraulic pump driven by the engine;

a plurality of actuators driven by pressurized hydraulic fluid discharged from the hydraulic pump;

a plurality of flow control valves for controlling the flow rate of the pressurized hydraulic fluid supplied from the hydraulic pump to the actuators;

maximum load pressure detecting means for detecting a maximum load pressure from among the load pressures of the actuators when the actuators are in operation and detecting tank pressure when the actuators are not in operation, thereby outputting the detected pressure as a signal pressure;

load sensing control means for controlling the displacement volume of the hydraulic pump such that the discharge pressure of the hydraulic pump becomes higher than the signal pressure by a target differential pressure;

an unloading valve connected to a hydraulic fluid supply line through which the pressurized hydraulic fluid discharged from the hydraulic pump is supplied to the flow control valves, and operative to open to return the hydraulic fluid discharged from the hydraulic pump to a tank when the discharge pressure of the hydraulic pump is higher than the signal pressure by a pressure set for the unloading valve;

a main relief valve connected to the hydraulic fluid supply line and operative to open to return the hydraulic fluid discharged from the hydraulic pump to the tank when the discharge pressure of the hydraulic pump is higher than a first pressure set as relief pressure, thereby limiting maximum pressure in the hydraulic fluid supply line to the first pressure or below; and relief pressure altering means for manually switching the relief pressure of the main relief valve between the first pressure and a second pressure for engine start-up that is lower than the first pressure and allows the main relief valve to return the hydraulic fluid discharged from the hydraulic pump to the tank in conjunction with the unloading valve when the actuators are not in operation, wherein the second pressure for engine start-up is a pressure that allows the main relief valve to open to return the hydraulic fluid discharged from the hydraulic pump to the tank in conjunction with the unloading valve when the actuators are not in operation under an ambient temperature below freezing point.

* * * * *